United States Patent [19]

Umemura

[11] Patent Number: 4,493,294

[45] Date of Patent: Jan. 15, 1985

[54] COOLING SYSTEM OF V-TYPE INTERNAL COMBUSTION ENGINE

[75] Inventor: Yukio Umemura, Yokohama, Japan

[73] Assignee: Nissan Motor Co., Ltd., Yokohama, Japan

[21] Appl. No.: 449,987

[22] Filed: Dec. 15, 1982

[30] Foreign Application Priority Data

Dec. 22, 1981 [JP] Japan ..... 56-207571

[51] Int. Cl.[3] ..... F01P 3/02

[52] U.S. Cl. ..... 123/41.33; 123/41.74

[58] Field of Search ..... 123/41.08, 41.09, 41.1, 123/41.74, 41.44, 41.33

[56] References Cited

U.S. PATENT DOCUMENTS

| | | | |
|---|---|---|---|
| 1,963,172 | 6/1934 | Meyer | 123/41.74 |
| 2,479,585 | 8/1949 | Monroe | 123/41.44 |
| 2,807,245 | 9/1957 | Unger | 123/41.1 |
| 4,346,676 | 8/1982 | Tyner | 123/41.74 |
| 4,382,427 | 5/1983 | Lyndhurst | 123/41.74 |

FOREIGN PATENT DOCUMENTS

| | | |
|---|---|---|
| 5629243 | 8/1954 | Japan . |
| 5655748 | 10/1954 | Japan . |

*Primary Examiner*—William A. Cuchlinski, Jr.

*Attorney, Agent, or Firm*—Schwartz, Jeffery, Schwaab, Mack, Blumenthal & Koch

[57] ABSTRACT

A cooling system of a V-type internal combustion engine comprises a coolant passage formed around each engine cylinder. A coolant gallery is formed between the two cylinder banks of a cylinder block of the engine and extends along the row of the engine cylinders of each cylinder bank, the coolant gallery being in communication with a coolant pump at the outlet member. Additionally, the coolant gallery is formed with a plurality of communication holes through each of which the coolant gallery is in direct communication with the coolant passage formed around each engine cylinder. Accordingly, all the engine cylinders are uniformly cooled while achieving uniform distribution of the coolant from the coolant pump into the two cylinder banks.

8 Claims, 3 Drawing Figures

COOLING SYSTEM OF V-TYPE INTERNAL COMBUSTION ENGINE

BACKGROUND OF THE INVENTION

1. Field of the Invention

This invention relates in general to a cooling system of an internal combustion engine, and more particularly to an improvement in the cooling system of a liquid cooled V-type internal combustion engine.

2. Description of the Prior Art

In general, most automotive internal combustion engines are provided with an engine cooling system of the type wherein cooling is effected with cooling water which circulates under the action of a water pump. This has been employed also in V-type internal combustion engines having a cylinder block with two angularly disposed cylinder banks each having a plurality of engine cylinders. However, drawbacks have been encountered with the thus arranged V-type internal combustion engines, in which some engine cylinders are not sufficiently cooled and uniform distribution of the coolant to the two cylinder banks is not obtained.

SUMMARY OF THE INVENTION

A cooling system, according to the present invention, of a V-type internal combustion engine comprises a coolant passage formed around each engine cylinder. A coolant gallery is formed between the two cylinder banks of a cylinder block of the engine and extends along the row of engine cylinders of each cylinder bank. The coolant gallery is in communication with a coolant pump at the inlet conduit. Additionally, the coolant gallery is formed with a plurality of communication holes through each of which the coolant gallery is in direct communication with the coolant passage formed around each engine cylinder. Accordingly, all the engine cylinders are uniformly cooled under the generally same condition while achieving uniform distribution of the coolant into the two cylinder banks. Besides, complicated piping for supplying the coolant from the coolant pump become unnecessary, thereby simplifying the construction of whole the cooling system.

BRIEF DESCRIPTION OF THE DRAWINGS

The features and advantages of the cooling system of a V-type internal combustion engine will be more clearly appreciated from the following description taken in conjunction with the accompanying drawings in which the same reference numerals designate the same parts and elements, in which.

DETAILED DESCRIPTION OF THE INVENTION

Figure 1:
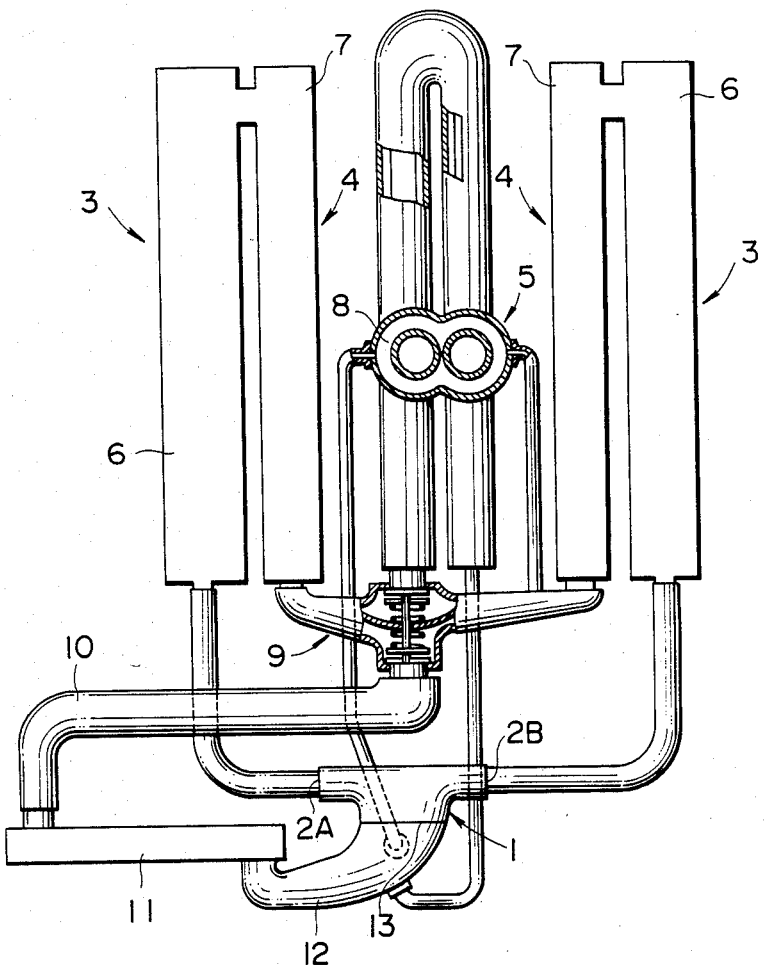
FIG.1 PRIOR ART
FIG. 1 is a schematic illustration of a conventional cooling system of a V-type internal combustion engine.

To facilitate understanding the present invention, a brief reference will be made to a conventional cooling system of a V-type internal combustion engine, depicted in FIG. 1. The conventional cooling system is disclosed in U.S. Pat. No. 2,807,245 entitled "Water Heated Intake Manifold and Control System therefor". In this cooling system, coolant discharged from two outlets 2A and 2B of a coolant pump 1 is introduced through the front ends of cylinder block cooling jackets 6 and 6 formed respectively in two cylinder banks 3 and 3 and admitted to cylinder head cooling jackets 7 and 7 formed respectively in two cylinder heads 4 and 4. Additionally, the coolant is admitted also to an intake manifold cooling jacket 8 formed in the intake manifold 5. The thus circulated coolant is gathered at a thermostat section 9 and then supplied through a passage 10 into a radiator 11 which cools the coolant with air during its passage therethrough. The thus cooled coolant is recirculated through a passage 12 to an inlet 13 of the coolant pump 1, so that the coolant again recirculates through the two cylinder banks 3 and 3 to accomplish engine cooling. The thermostat section 9 is located upstream of the radiator inlet passage 10 and arranged to control the amount of cooland to be supplied to the radiator 11 in response to the coolant temperature in order to regulate coolant temperature within an appropriate range (for example, 80°–90° C.).

With such a conventional cooling system of the V-type engine, the coolant discharged from the coolant pump 1 exerts cooling action on the engine cylinders of each cylinder bank 3 from the front cylinder to the rear cylinder. In other words, the rear cylinder is cooled by the coolant whose temperature is raised by the heat exchange which has taken place in the front engine cylinder. As a result, although the front engine cylinder is sufficiently cooled, the rear cylinder cooling is insufficient. Further, since the coolant flows through relatively narrow cooling jackets 6 which have a high flow resistance, it is necessary that the coolant pump 1 is large-sized. Moreover, the two outlets 2A and 2B are unavoidably required for the coolant pump 1, requiring piping for connecting the two coolant pumps outlets 2A and 2B with the respective cylinder block cooling jackets 6 and 6. This might not achieve uniform distribution of the coolant to the two cylinder banks 3 and 3, complicating the construction of whole the engine cooling system.

Figure 2:
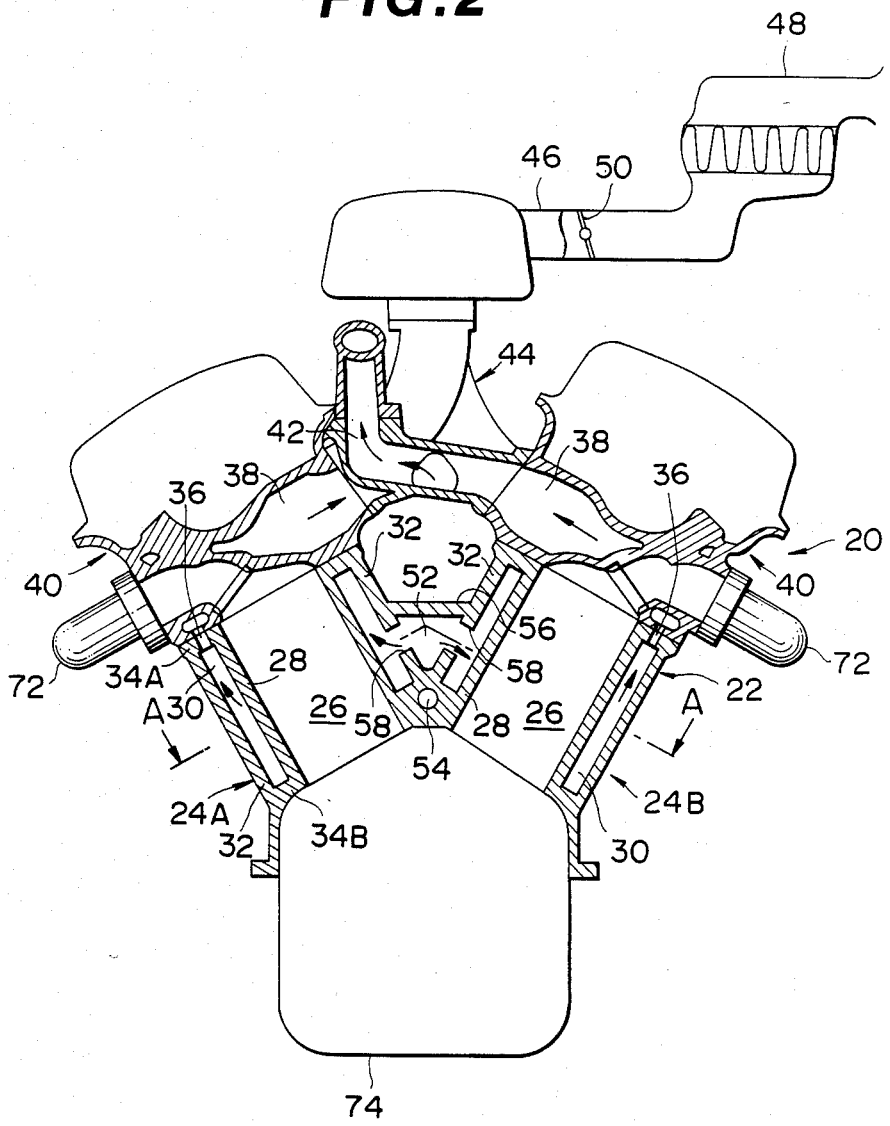
FIG. 2 is a schematic sectional view of a V-type internal combustion engine provided with a preferred embodiment of a cooling system in accordance with the present invention.
Figure 3:
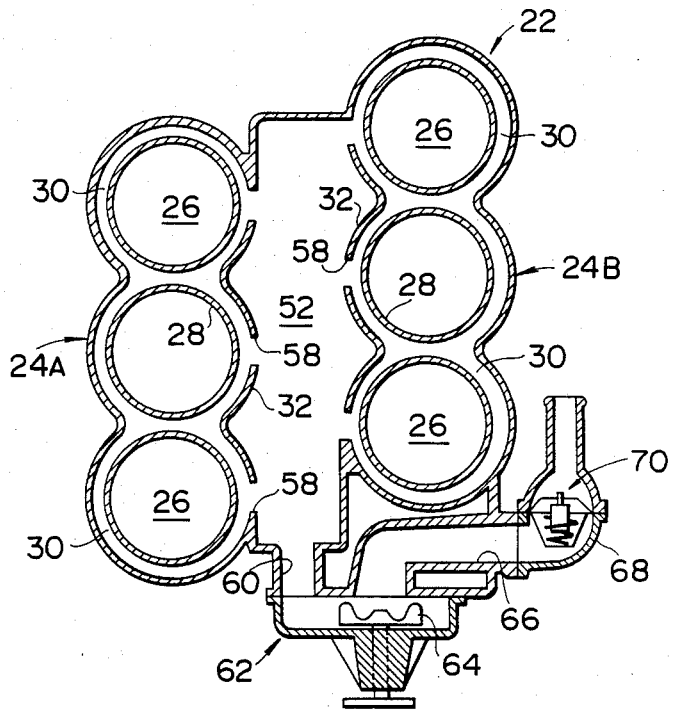
FIG. 3 is a cross-sectional view taken in the direction of arrows substantially along line A—A.

In view of the above description of the conventional cooling system of the V-type internal combustion engine, reference is now made to FIGS. 2 and 3, wherein a preferred embodiment of a cooling system of the present invention is illustrated in combination with a V-type internal combustion engine 20 which has a cylinder block 22 with two angularly disposed cylinder banks 24A and 24B. In other words, the two cylinder banks 24A and 24B are arranged V-shaped to form left and right cylinder banks 24A and 24B. In this instance, each cylinder bank 24A, 24B is provided with three engine cylinder bores 26 each defined by an engine cylinder or cylinder wall 28. The cylinder bores 26 are aligned along the length of the cylinder bank 24A, 24B.

A coolant (water) passage or jacket 30 is formed around each cylinder bore 26 and defined between the cylinder wall 28 and a cylinder block outer wall 32 and between upper and lower block decks 34A and 34B. The respective coolant passages 30 formed around the respective cylinder bores 26 in each cylinder bank 24A, 24B are in communication with each other as clearly shown in FIG. 3. Additionally, the coolant passage 30 also communicates through a communication opening 36 with a coolant passage or jacket 38 formed in a cylinder head 40 which is securely mounted on the top of the cylinder block 22 of each cylinder bank 24A, 24B. The coolant passage 38 in the cylinder head 40 is in turn in communication with a coolant passage or jacket 42 for an intake manifold 44. The intake manifold 44 communicates through an intake passage 46 with an air filter 48. The reference numeral 50 denotes a throttle valve.

A coolant gallery or expansion chamber 52 is formed in the vicinity of a connecting section of the two cylinder banks 24A and 24B and located at the generally central section of the cylinder block 22. The coolant gallery 52 is positioned in the vicinity of an engine lublicating oil passage 54 formed in the lower block deck 34B. Additionally, the coolant gallery 52 is generally triangular in cross-section and extends in the direction of the row of cylinder bores 26 of each cylinder bank 24A, 24B. In other words, this coolant gallery 52 is defined by the two opposite cylinder block outer walls 32 of the respective two cylinder banks 24A and 24B, and an upper wall 56 connecting the opposite cylinder block outer walls 32 in order that the coolant gallery has a predetermined volume. As clearly shown in FIG. 3, each cylinder block outer wall 32 defining the coolant gallery 52 is formed with three communication or coolant distribution holes 58. Each communication hole 58 is so formed that the coolant passage 30 formed around each cylinder bore 26 directly communicates therethrough with the coolant gallery 52, i.e., each hole 58 is formed at a location corresponding to each cylinder bore 26. It will be understood that the coolant supplied to the coolant gallery 52 is effectively distributed through the coolant distribution holes 58 into the coolant passages 30 formed around the respective cylinder bores 26.

The coolant gallery 52 is in direct communication with a single outlet conduit member 60 of a coolant or water pump 62 which is directly secured to the front end of the cylinder block outer wall 32. The coolant pump 62 has, as usual, vanes 64 which rotate in accordance with engine operation. As shown, the outlet conduit member 60 and an inlet conduit member 66 of the coolant pump 62 are formed integral with the cylinder block 22. Connected to the coolant pump inlet conduit member 66 is a conduit member 68 which serves as a bypass passage from a thermostat section 70 and as an outlet conduit of a radiator (not shown). It will be understood that the thermostat section 70 functions to control the flow of the coolant to the radiator in response to coolant temperature in order that the coolant temperature is maintained within an appropriate range. The thermostat section 70 is in communication with the cylinder head coolant passage 38 and the intake manifold coolant passage 42. The reference numeral 72 denotes exhaust manifolds, and 74 an oil pan.

The operation of the thus arranged cooling system will be discussed hereinafter.

The coolant or cooling water discharged from the coolant pump 62 is first admitted through the single inlet conduit member 60 into the coolant gallery 52 which has a relatively large volume, so that the flow rate of the coolant lowers while weakening the pulsation of the coolant due to the rotation of the coolant pump vanes 64. Thereafter, the coolant in the coolant gallery 52 flows through the distribution holes 58 into the coolant passage 30 formed around each cylinder bore 26 of the two cylinder banks 24A and 24B. Further, the coolant in each coolant passage 30 is admitted through the communication opening 36 into the coolant passage 38 of the cylinder head 40 and into the intake manifold coolant passage 42. This coolant is then supplied through the thermostat section 70 to the radiator (the same as in the system shown in FIG. 1) to be cooled. The thus cooled coolant is recirculated to the inlet conduit 66 of the coolant pump 62 and again circulates through the coolant pump outlet conduit member 60 into the coolant gallery 52.

Additionally, in this embodiment, the coolant gallery 52 is elongated in the direction of the row of the cylinder bores 26, and the coolant distribution holes 58 are formed at the locations corresponding to the respective cylinder bores 26. As a result, the coolant is uniformly and smoothly supplied, under the approximately same condition, to a plurality of coolant passages 30 respectively formed around the cylinder bores 26. It will be appreciated that this gives a much better cooling effect as compared with the conventional cooling system in which coolant which has cooled a cylinder wall cools a neighboring cylinder wall. Therefore, with this embodiment, the cooling efficiency of the coolant per unit volume is considerably improved. Further, since the coolant in the coolant gallery 52 flows slowly and the pulsation of the coolant is reduced, uniform distribution of the coolant to the respective coolant passages 30 is more effectively achieved.

Furthermore, since the inlet and outlet conduit members of the coolant pump 62 are formed integral with the cylinder block 22, the coolant pump 62 is directly mounted on the cylinder block outer wall 32 without using a special independent casing provided with pump inlet and outlet while achieving direct discharge of the coolant into the coolant gallery 52 which is low in flow resistance. Consequently, it becomes possible to use a smaller coolant pump, thereby simplifying whole the cooling system. Additionally, the coolant pump 62 is provided with the single outlet conduit member 60 and coolant distribution to the coolant passages of the two cylinder banks 24A and 24B is carried out through the coolant gallery 52, thereby hardly making a difference in coolant distribution to the two cylinder banks 24A and 24B. Moreover, since the coolant gallery 52 is formed in close proximity to the engine lubricating oil passage 54, the engine lubricating oil can be sufficient cooled with a large amount of coolant, thus preventing deterioration of the properties of the oil. This maintains good lubrication of various sliding parts of the engine for a long period of time.

As is appreciated from the above, in the cooling system according to the present invention, the V-type internal combustion engine is provided with the coolant gallery which is located between the two cylinder banks and extends in the direction of the rows of cylinder bores. The coolant gallery is in communication with the coolant pump outlet. Additionally, the coolant gallery is provided at its side walls with a plurality of coolant distribution holes through which the coolant supplied from the coolant pump outlet to the coolant gallery is uniformly distributed to the coolant passages formed respectively around the cylinder bores. Accordingly, the cooling efficiency of the coolant per unit volume can be greatly improved while improving the distribution of the coolant into the respective coolant passages around the cylinder bores. Besides, whole the cooling system becomes small-sized and simplified, thereby achieving cost reduction. Moreover, since the two cylinder banks co-operate with each other to form the coolant gallery therebetween, the rigidity of the two cylinder banks is improved. This makes it possible to use a cylinder block of smaller size and lower wall thickness, thereby lightening engine weight.

What is claimed is:

1. A cooling system of a V-type internal combustion engine having a cylinder block with two angularly disposed first and second cylinder banks each having a plurality of engine cylinders, comprising:

means defining a coolant passage formed around each engine cylinder;

means defining a coolant gallery located between the first and second cylinder banks and extending along the row of engine cylinder of each cylinder bank, said coolant gallery being in communication with a coolant pump at an outlet member; and a partition wall for separating said coolant gallery from each coolant passage formed around the engine cylinder of each cylinder bank, each partition wall being formed with a plurality of communication holes through each of which said coolant gallery is in direct communication with each coolant passage formed around each engine cylinder.

2. A cooling system as claimed in claim 1, wherein said coolant gallery is defined by two opposite cylinder block outer walls of the respective first and second cylinder banks, which outer walls are connected with each other, and a wall member connecting said two opposite cylinder block outer walls.

3. A cooling system as claimed in claim 2, wherein each cylinder block outer wall is formed with said communication holes, each communication hole being formed at a location corresponding to each engine cylinder.

4. A cooling system as claimed in claim 2, wherein said coolant gallery is located in the vicinity of an oil passage through which engine lubricating oil passes.

5. A cooling system as claimed in claim 4, wherein said oil passage is formed in a connecting section at which said two opposite cylinder block outer walls are integrally connected with each other.

6. A cooling system as claimed in claim 1, wherein the outlet member of said coolant pump is formed integral with the cylinder block.

7. A cooling system as claimed in claim 6, wherein said coolant pump is provided with an inlet member which is formed integral with the cylinder block.

8. A cooling system as claimed in claim 1, further comprising means defining a coolant passage formed in a cylinder head secured to the top of the cylinder block, said cylinder head coolant passage being in communication with said coolant passage formed around each engine cylinder.

* * * * *